US006022204A

United States Patent [19]

Murayama et al.

[11] Patent Number: 6,022,204

[45] Date of Patent: Feb. 8, 2000

[54] VANE COMPRESSOR HAVING A SINGLE SUCTION GROOVE FORMED IN A SIDE MEMBER WHICH IS IN DIRECT CONTACT WITH A CAM RING

[75] Inventors: Toshihiro Murayama; Shunji Muta; Tomoyasu Takahashi, all of Kounan-machi, Japan

[73] Assignee: Zexel Corporation, Tokyo, Japan

[21] Appl. No.: 09/156,165

[22] Filed: Sep. 17, 1998

Related U.S. Application Data

[63] Continuation of application No. 08/755,262, Nov. 22, 1996, Pat. No. 5,924,856.

[30] Foreign Application Priority Data

Dec. 8, 1995 [JP] Japan ..... 7-345756

[51] Int. Cl.[7] ..... F04C 18/344

[52] U.S. Cl. ..... 418/259

[58] Field of Search ..... 418/15, 133, 259, 418/265–269

[56] References Cited

U.S. PATENT DOCUMENTS

| | | | |
|---|---|---|---|
| 2,435,279 | 2/1948 | Hubacker | 418/267 |
| 3,255,704 | 6/1966 | Mazur | 418/268 |
| 4,514,157 | 4/1985 | Nakamura et al. | 418/259 |
| 4,619,595 | 10/1986 | Amano et al. | 418/259 |
| 4,636,148 | 1/1987 | Takao et al. | 418/259 |
| 4,986,741 | 1/1991 | Nakajima et al. | 418/268 |

FOREIGN PATENT DOCUMENTS

| | | | |
|---|---|---|---|
| 57-393 | 1/1982 | Japan | 418/259 |
| 61-4885 | 1/1986 | Japan | 418/259 |
| 3-18683 | 1/1991 | Japan . | |
| 5-288178 | 11/1993 | Japan | 418/259 |

*Primary Examiner*—John J. Vrablik

*Attorney, Agent, or Firm*—Frishauf, Holtz, Goodman, Langer & Chick, P.C.

[57] ABSTRACT

A vane compressor has at least one of a front-side member and a rear-side member thereof formed with a suction chamber opening toward a cam ring, which has a substantially arcuate or annular shape and extends around a drive shaft. The cam ring has one end face formed with a refrigerant inlet port for supplying a low-pressure refrigerant into compression chambers formed between vanes. Alternatively, a front head is arranged on one end face of the cam ring. A shell encloses another end and an outer peripheral surface of the cam ring and holds a movable plate in a state opposed to the other end face of the cam ring such that the movable plate can be moved along a central axis of the drive shaft. An inside of the shell and the movable plate defines a high-pressure chamber therein. Each adjacent pair of the vanes, the front head, and the movable plate defines a compression chamber therein. The shell has a front-side end extending to an outer peripheral surface of the front head and fixed to the outer peripheral surface of the front head. The outer peripheral surface of the cam ring and an inner peripheral surface of the front-side end of the shell defines a low-pressure space therebetween. The cam ring is formed with an inlet port opening through an outer peripheral wall thereof for supplying a low-pressure refrigerant into the compression chambers during a suction stroke.

2 Claims, 16 Drawing Sheets

VANE COMPRESSOR HAVING A SINGLE SUCTION GROOVE FORMED IN A SIDE MEMBER WHICH IS IN DIRECT CONTACT WITH A CAM RING

This is a continuation of application Ser. No. 08/755,262 filed Nov. 22, 1996, U.S. Pat. No. 5,924,856.

BACKGROUND OF THE INVENTION

1. Field of the Invention

This invention relates to a vane compressor, and more particularly to a vane compressor having component parts which are unitized so as to reduce the total number of component parts of the vane compressor, and dispense with sealing portions conventionally arranged between the component parts which are unitized according to the present invention.

2. Description of the Prior Art

Conventionally, a vane compressor as shown in FIG. 1 is proposed e.g. by Japanese Laid-Open Patent Publication (Kokai) No. 3-18683, which is comprised of a cam ring 801, a front side block 803 and a rear side block 804 secured to opposite ends of the cam ring 801, a rotor 802 rotatably received within the cam ring 801, a front head 805 and a rear head 806 respectively secured to outer ends of the side blocks 803, 804, and a drive shaft 807 for rotating the rotor 807. The drive shaft 807 is rotatably supported by bearings 808, 809 arranged in the side blocks 803, 804, respectively.

Recently, aluminum or aluminum alloy (hereinafter both referred to as "aluminum-based metal") is widely employed as a material of the main component parts of compression mechanism of the vane compressor, such as the cam ring 801 and the front side block 803, to reduce the weight of the compressor.

Further, sealing members, such as O-rings, are interposed between the cam ring 801 and the front side block 803, between the cam ring 801 and the rear side block 804, between the front side block 803 and the front head 805, between the rear side block 804 and the rear head 806, to ensure air-tightness of the vane compressor.

These main component parts of the compression mechanism of the conventional vane compressor including the cam ring 801, the front side block 803, the rear side block 804, the front head 805 and the rear head 806 are separately formed by casting. When all these component parts are made of aluminum-based materials, the manufacturing costs of the vane compressor are increased due to the cost of the aluminum-based materials, and additional surface-treatments required to be provided on the component parts formed of these materials.

Further, when these component parts are formed separately, the number of component parts of the compressor is increased to increase the whole size of the compressor, and also the number of sealing members to be provided between these component parts is increased to increase the number of portions susceptible to possible leaks.

SUMMARY OF THE INVENTION

It is an object of the invention to provide a vane compressor having component parts which are unitized so as to reduce the total number of component parts of the vane compressor, and dispense with sealing portions conventionally arranged between the component parts which are unitized according to the present invention.

To attain the object, according to a first aspect of the invention, there is provided a vane compressor including a cam ring, a front-side member arranged on one end face of the cam ring, a rear-side member arranged on another end face of the cam ring, a drive shaft rotatably supported by the front-side member and the rear-side member and extending through the cam ring, a rotor rigidly fitted on the drive shaft and rotatably received within the cam ring, the rotor having a plurality of vane slits formed therein, and vanes respectively received within the vane slits.

The vane compressor according to the first aspect of the invention is characterized in that at least one of the front-side member and the rear-side member is formed with a suction chamber opening toward the cam ring, which has a substantially arcuate or annular shape and extends around the drive shaft, and the cam ring has one of the one end face and the another end face formed with a refrigerant inlet port for supplying a low-pressure refrigerant into compression chambers formed between the vanes during a suction stroke.

In the vane compressor according to the first aspect of the invention, at least one of the front-side member and the rear-side member is formed with a suction chamber opening toward the cam ring, which has a substantially arcuate or annular shape and extends around the drive shaft, and the cam ring has one end formed with a refrigerant inlet port for supplying a low-pressure refrigerant into compression chambers formed between the vanes during a suction stroke. Therefore, one of the side blocks can be eliminated to reduce the number of component parts of the vane compressor and the amount of aluminum-based materials used. Further, the number of portions requiring sealing is decreased, and the longitudinal length of the vane compressor can be shortened.

Preferably, the suction chamber is formed in one of the front-side member and the rear-side member, and a high-pressure chamber is formed in another of the front-side member and the rear-side member in a manner opening toward the cam ring for being supplied with a high-pressure refrigerant discharged from the compression chambers.

According to this preferred embodiment of the first aspect of the invention, both the side blocks can be eliminated.

Alternatively, the another of the front-side member and the rear-side member is formed by a head and a side block interposed between the head and the cam ring, the high-pressure chamber being formed in the head, and the side block having a passage formed therethrough for supplying the high-pressure refrigerant discharged from the compression chambers into the high-pressure chamber.

According to a second aspect of the invention, there is provided a vane compressor including a cam ring, a front-side member arranged on one end face of the cam ring, a rear-side member arranged on another end face of the cam ring, a drive shaft rotatably supported by the front-side member and the rear-side member and extending through the cam ring, a rotor rigidly fitted on the drive shaft and rotatably received within the cam ring, the rotor having a plurality of vane slits formed therein, and vanes respectively received within the vane slits.

The vane compressor according to the second aspect of the invention is characterized in that at least one of the front-side member and the rear-side member is formed with a suction chamber opening toward the cam ring, which has a substantially arcuate or annular shape and extends around the drive shaft, and at least one of the front-side member and the rear-side member is formed with a refrigerant inlet port opening toward the cam ring for supplying a low-pressure refrigerant into compression chambers formed between the vanes during a suction stroke.

The vane compressor according to the second aspect of the invention has the same advantageous effects as obtained by that according to the first aspect of the invention.

Preferably, the suction chamber is formed in one of the front-side member and the rear-side member, and a high-pressure chamber is formed in another of the front-side member and the rear-side member in a manner opening toward the cam ring for being supplied with a high-pressure refrigerant discharged from the compression chambers.

According to a third aspect of the invention, there is provided a vane compressor, comprising, a cam ring, a drive shaft extending through the cam ring, a rotor rigidly fitted on the drive shaft and rotatably received within the cam ring, the rotor having a plurality of vane slits formed therein, vanes received in the vane slits, respectively, a front-side member arranged on one end face of the cam ring, a shell enclosing an another end face and an outer peripheral surface of the cam ring, and a movable plate held by the shell in a state opposed to the another end face of the cam ring such that the movable plate can be moved along a central axis of the drive shaft, an inside of the shell and the movable plate defining a high-pressure chamber therein, each adjacent pair of the vanes, the front-side member, and the movable plate defining a compression chamber therein, the shell having a front-side end extending to an outer peripheral surface of the front-side member and fixed to the outer peripheral surface of the front-side member, the outer peripheral surface of the cam ring and an inner peripheral surface of the front-side end of the shell defining a low-pressure space therebetween, and the cam ring being formed with an inlet port opening in the outer peripheral surface for supplying a low-pressure refrigerant into the compression chambers during a suction stroke.

In the third aspect of the invention, the side blocks can be eliminated to reduce the number of component parts of the vane compressor and the whole amount of aluminum-based materials used. Further, the number of portions requiring sealing is decreased, and the longitudinal length of the vane compressor can be shortened.

Further, the inner space within the cam ring is surrounded by the low-pressure space formed between the outer peripheral surface of the cam ring and the inner peripheral surface of the shell so that no force is applied to the cam ring in a radially inward direction. Therefore, the inner peripheral surface of the cam ring is prevented from being brought into contact with the outer peripheral surface of the rotor, and at the same time, in a so-called liquid compression state of the compressor, although the pressure within the compression space within the cam ring is fairly higher than the pressure within the low-pressure space, the cam ring expands to lower the pressure within the compression space to thereby prevent breakage of the compressor due to the liquid compression.

According to a fourth aspect of the invention, there is provided a vane compressor, comprising a cam ring, a drive shaft extending through the cam ring, a rotor rigidly fitted on the drive shaft and rotatably received within the cam ring, the rotor having a plurality of vane slits formed therein, vanes received in the vane slits, respectively, a side member arranged on one end face of the cam ring, and a shell enclosing an another end face and an outer peripheral surface of the cam ring, the side member being formed by a head arranged on the one end face of the cam ring, and a movable plate held by the head in a state opposed to the another end face of the cam ring such that the movable plate can be moved along a central axis of the drive shaft, the head being formed with a high-pressure chamber which opens toward the cam ring for being supplied with a high-pressure refrigerant discharged from compression chambers formed between the vanes, the movable plate separating the high-pressure chamber and the compression chambers from each other, the shell having an end fixed to an outer peripheral surface of the head, the shell being formed with a low-pressure chamber opening toward the cam ring and extending around a hole receiving the drive shaft to form a substantially annular shape, and an inlet port for supplying a low-pressure refrigerant from the low-pressure chamber into the compression chambers during a suction stroke.

In the fourth aspect of the invention, the side blocks can be eliminated to reduce the number of component parts of the vane compressor and the whole amount of aluminum-based materials used. Further, the number of portions requiring sealing is decreased, and the longitudinal length of the vane compressor can be shortened.

Further, the inner space within the cam ring is surrounded by the low-pressure space formed between the outer peripheral surface of the cam ring and the inner peripheral surface of the shell so that no force is applied to the cam ring in a radially inward direction. Therefore, the inner peripheral surface of the cam ring is prevented from being brought into contact with the outer peripheral surface of the rotor, and at the same time, in a so-called liquid compression state of the compressor, although the pressure within the compression space within the cam ring is fairly higher than the pressure within the low-pressure space, the cam ring expands to lower the pressure within the compression space to thereby prevent breakage of the compressor due to the liquid compression.

According to a fifth aspect of the invention, there is provided a vane compressor, comprising, a cam ring, a drive shaft extending through the cam ring, a rotor rigidly fitted on the drive shaft and rotatably received within the cam ring, the rotor having a plurality of vane slits formed therein, vanes received in the vane slits, respectively, a front head arranged on one end face of the cam ring, and a rear-side member arranged on another end face of the cam ring, the rear-side member being formed by a rear head arranged on the another end face of the cam ring, and a movable plate held by the rear head in a state opposed to the another end face of the cam ring such that the movable plate can be moved along a central axis of the drive shaft, the rear head being formed therein with a high-pressure chamber for being supplied with a high-pressure refrigerant discharged from compression chambers formed between the vanes, the front head and the cam ring being formed as a unitary member, the rear head having a front-side end fixed to an outer peripheral surface of the cam ring in a manner enclosing the outer peripheral surface of the cam ring, the cam ring being formed with a low-pressure chamber opening toward the rear-side member and extending around the drive shaft to form a substantially annular shape, such that the low-pressure chamber surrounds an inner space within the cam ring by way of a wall, the wall having an inlet port formed therethrough for supplying a low-pressure refrigerant from the low-pressure chamber into the compression chambers during a suction stroke, the movable plate separating the low-pressure chamber and the inner space from the high-pressure chamber.

In the fifth aspect of the invention, the side blocks can be eliminated to reduce the number of component parts of the vane compressor and the whole amount of aluminum-based materials used. Further, the number of portions requiring sealing is decreased, and the longitudinal length of the vane compressor can be shortened.

Further, the inner space within the cam ring is surrounded by the low-pressure space formed between the outer peripheral surface of the cam ring and the inner peripheral surface of the shell so that no force is applied to the cam ring in a radially inward direction. Therefore, the inner peripheral surface of the cam ring is prevented from being brought into contact with the outer peripheral surface of the rotor, and at the same time, in a so-called liquid compression state of the compressor, although the pressure within the compression space within the cam ring is fairly higher than the pressure within the low-pressure space, the cam ring expands to lower the pressure within the compression space to thereby prevent breakage of the compressor due to the liquid compression.

According to a sixth aspect of the invention, there is provided, a vane compressor, comprising a cam ring, a drive shaft extending through the cam ring, a rotor rigidly fitted on the drive shaft and rotatably received within the cam ring, the rotor having a plurality of vane slits formed therein, vanes received in the vane slits, respectively, a front-side member arranged on one end face of the cam ring, and a rear-side member arranged on another end face of the cam ring, the front-side member being formed with a low-pressure chamber opening toward the cam ring and extending around the drive shaft to form a substantially annular shape, the cam ring being formed with an inlet port opening toward the front-side member for supplying a low-pressure refrigerant from the low-pressure chamber into the compression chambers during a suction stroke, a rear head having a substantially H-shaped cross-section being arranged on the one end face of the cam ring, the cam ring having a rear-side outer peripheral wall end which extends such that the rear-side outer peripheral wall end encloses the rear head, and is fixed to an rear-side end of the rear head, the rear-side member being formed by the rear-side outer peripheral wall end and the rear head, and having a high-pressure chamber formed therein for being supplied with a high-pressure refrigerant discharged from the compression chambers.

In the sixth aspect of the invention, the side blocks can be eliminated to reduce the number of component parts of the vane compressor and the whole amount of aluminum-based materials used. Further, the number of portions requiring sealing is decreased, and the longitudinal length of the vane compressor can be shortened. As a result, the manufacturing costs can be reduced, while preventing leakage of the refrigerant more effectively and reducing the size of the whole compressor.

Further, since the rear head having the substantially H-shaped cross-section, and the high-pressure chamber is formed by the rear-side end (extension) of the cam ring and the rear head. Therefore, a large space can be secured for the discharge chamber, which therefore can sufficiently play the role of an oil sump for supplying oil to the sealing portions.

According to a seventh aspect of the invention, there is provided a vane compressor, comprising a cam ring, a drive shaft extending through the cam ring, a rotor rigidly fitted on the drive shaft and rotatably received within the cam ring, the rotor having a plurality of vane slits formed therein, vanes received in the vane slits, respectively, a rear-side member arranged on a rear-side of the cam ring, the rear-side member having a substantially H-shaped cross-section, and a shell enclosing a front-side end and an outer peripheral surface of the cam ring, and the rear-side member, the shell being formed with a low-pressure chamber opening toward the cam ring and extending around the drive shaft to form a substantially annular shape, the cam ring having a front-side end formed with an inlet port for supplying a low-pressure refrigerant from the low-pressure chamber into compression chambers formed between the vanes during a suction stroke, the shell having a rear-side end fixed to a rear-side end of the rear-side member, the rear-side end of the shell and the rear-side member defining a high-pressure chamber therein for being supplied with a high-pressure refrigerant discharged from the compression chambers.

In the seventh aspect of the invention, the side blocks can be eliminated to reduce the number of component parts of the vane compressor and the whole amount of aluminum-based materials used. Further, the number of portions requiring sealing is decreased, and the longitudinal length of the vane compressor can be shortened.

Further, since the rear head having the substantially H-shaped cross-section, and the high-pressure chamber is formed by the rear-side end (extension) of the shell and the rear head. Therefore, a large space can be secured for the discharge chamber, which therefore can sufficiently play the role of an oil sump for supplying oil to the sealing portions.

According to an eighth aspect of the invention, there is provided a vane compressor, comprising a cam ring, a drive shaft extending through the cam ring, a rotor rigidly fitted on the drive shaft and rotatably received within the cam ring, the rotor having a plurality of vane slits formed therein, vanes received in the vane slits, respectively, a front head having a substantially H-shaped cross-section and arranged on one end face of the cam ring, a rear head having a substantially H-shaped cross-section and arranged on another end face of the cam ring, and a shell enclosing the front head and the rear head, the shell and the cam ring being formed as a unitary member, the shell having a rear-side end fixed to a rear-side end of the rear head, the rear-side end of the shell and the rear head defining a high-pressure chamber therein for being supplied with a high-pressure refrigerant discharged from compression chambers defined between the vanes, the front-side end of the shell and the front head defining a low-pressure chamber for supplying a low-pressure refrigerant into the compression chambers, and the cam ring having a front-side end formed with an inlet port for supplying the low-pressure refrigerant from the low-pressure chamber into the compression chambers during a suction stroke.

In the eighth aspect of the invention, the side blocks can be eliminated to reduce the number of component parts of the vane compressor and the whole amount of aluminum-based materials used. Further, the number of portions requiring sealing is decreased, and the longitudinal length of the vane compressor can be shortened.

Further, the front head and the rear head each having the substantially H-shaped cross-section are employed, while the low-pressure chamber is formed by the front-side end (extension) of the shell and the front head, and the high-pressure chamber by the rear-side end (extension) of the shell and the rear head. Therefore, large spaces can be secured for the low-pressure chamber and the high-pressure chamber.

The above and other objects, features and advantages of the present invention will become more apparent from the following description taken in conjunction with the accompanying drawings.

DETAILED DESCRIPTION OF THE PREFERRED EMBODIMENTS

Next, the invention will now be described in detail with reference to drawings showing preferred embodiments thereof.

Figure 1:
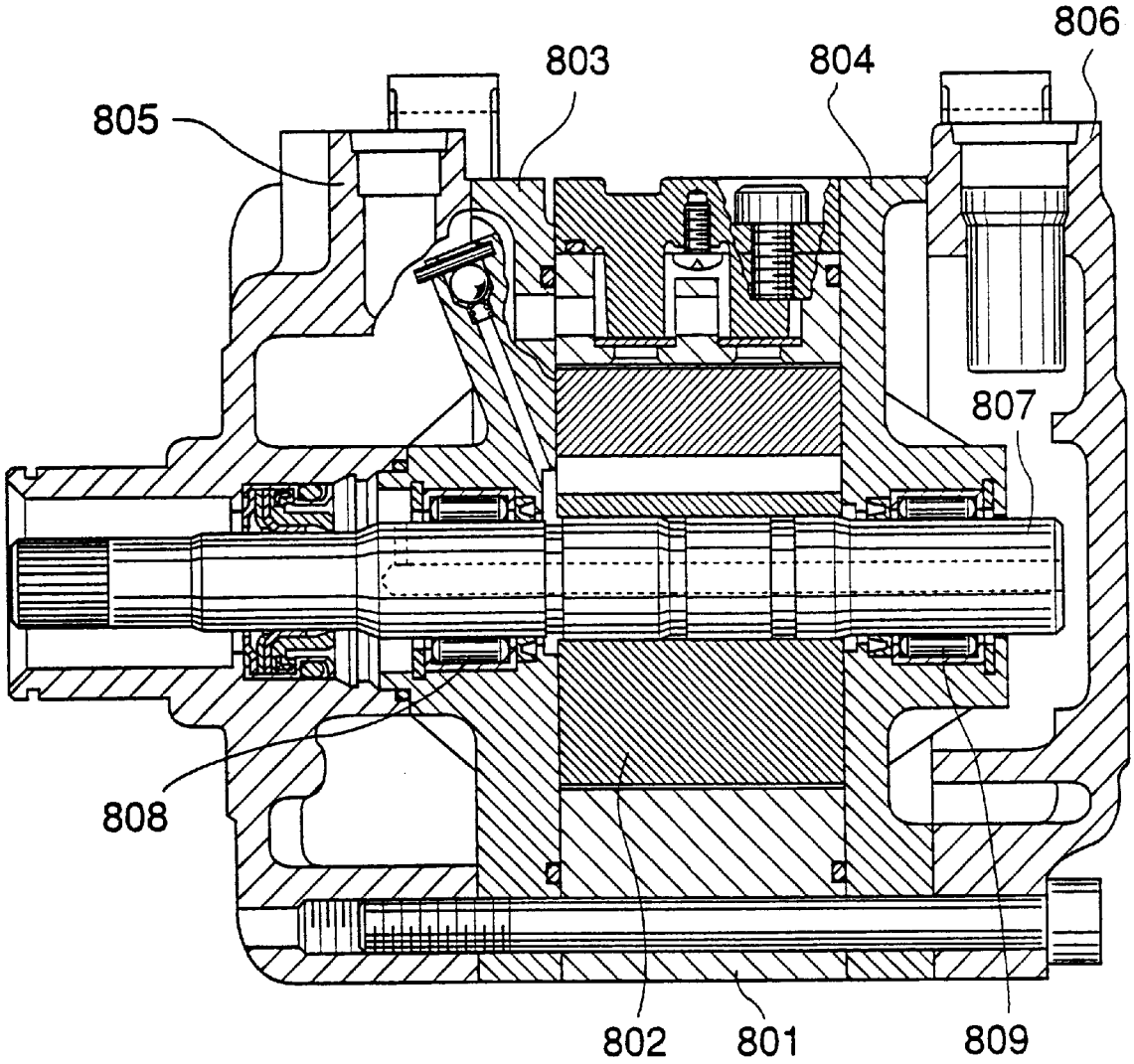
FIG.1 PRIOR ART
FIG. 1 is a longitudinal cross-sectional view showing the whole arrangement of a conventional vane compressor.
Figure 2:
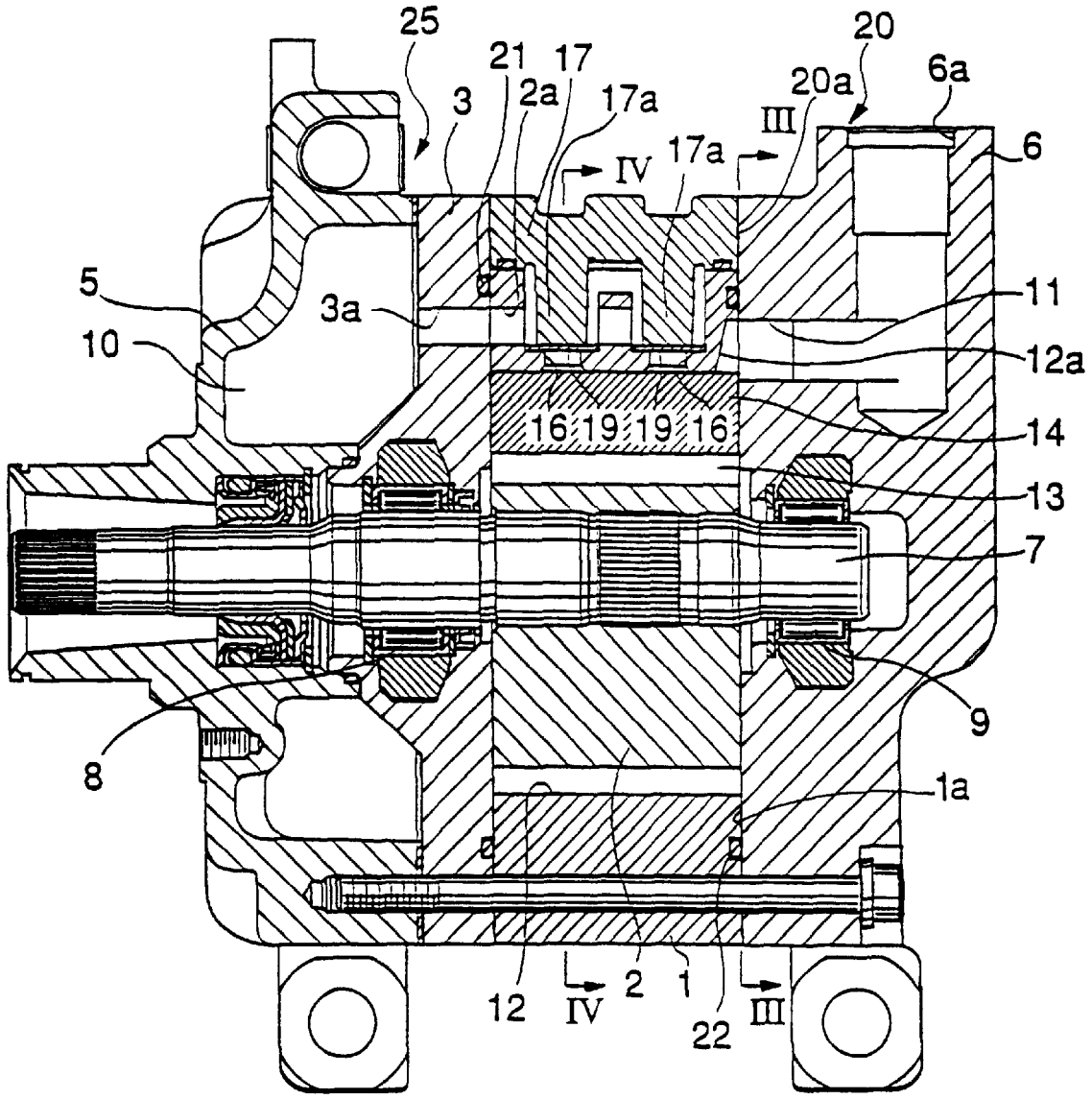
FIG. 2 is a longitudinal cross-sectional view showing the whole arrangement of a vane compressor according to a first embodiment of the invention.
Figure 3:
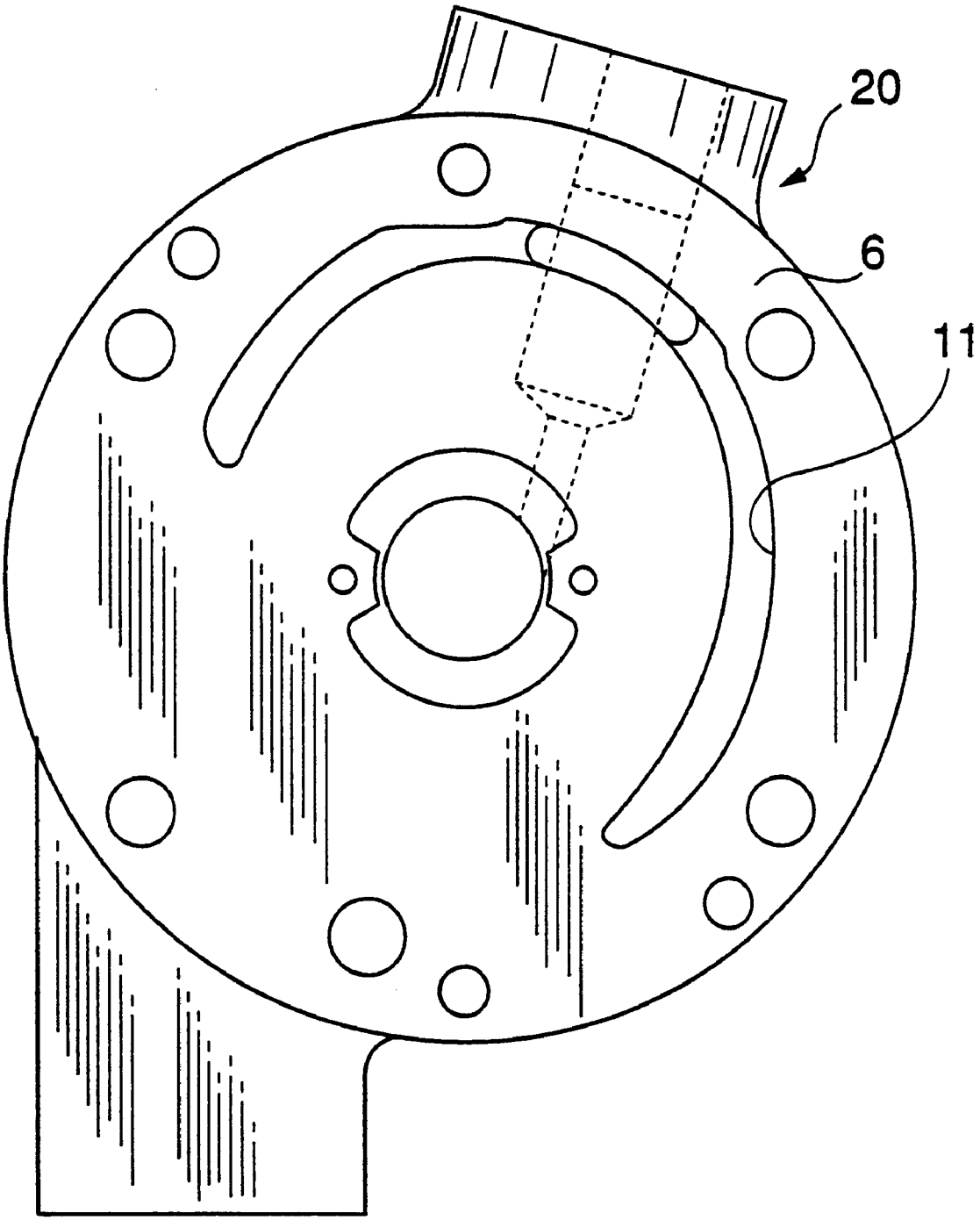
FIG. 3 is an end view of the FIG. 2 vane compressor taken on line III—III of FIG. 2.
Figure 4:
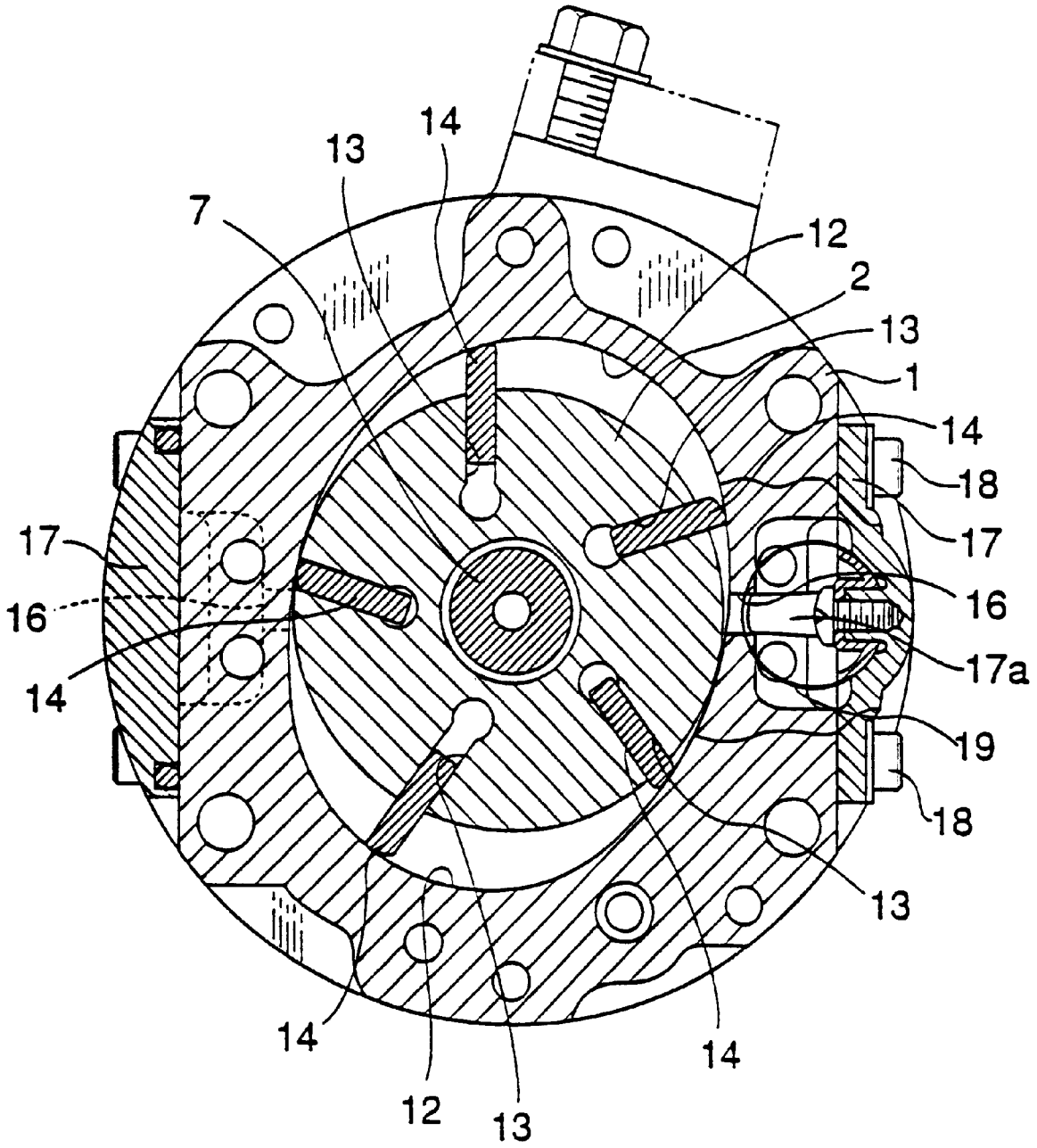
FIG. 4 is a cross-sectional view of the FIG. 2 vane compressor taken on line IV—IV of FIG. 2.

FIG. 2 shows a vane compressor along the longitudinal axis thereof according to a first embodiment of the invention. FIG. 3 is an end view taken on line III—III of FIG. 2. FIG. 4 is a cross-sectional view taken on line IV—IV of FIG. 2. The vane compressor is comprised of a cam ring 1, a front-side member 25 and a rear-side member 20 arranged on open opposite ends of the cam ring 1, a rotor 2 rotatably received within the cam ring 1, and a drive shaft 7 on which is secured the rotor 2. The drive shaft 7 is rotatably supported by a pair of radial bearings 8 and 9 provided in the front-side and rear-side members 25 and 20, respectively.

The front-side member 25 is comprised of a front side block 3 secured to a front-side end face of the cam ring 1 via an O ring 21, and a front head 5 secured to a front-side end face of the front side block 3.

The front head 5 is formed with a discharge port, not shown, through which a refrigerant gas is to be discharged as a thermal medium, and the discharge port is communicated with a discharge chamber 10 formed by an inner space of the front head 5, which opens toward the front side block 3, and the front side block 3 closing the opening of the inner space of the front head 5.

The rear-side member 20 is formed by a rear head 6 alone which is secured to an rear-side end face of the cam ring 1 via an O ring 22. The rear head 6 is formed with a suction port 6*a* through which the refrigerant gas is to be drawn into the compressor. The suction port 6*a* communicates with a single suction chamber (low-pressure chamber) 11, described below.

The rear head 6 is formed with the single suction groove or chamber 11 opening in an end face of the rear head 6 which faces toward the cam ring 1 such that it extends around and is spaced radially outward from, a recess formed in the rear head for receiving the drive shaft 7, to form a substantially arcuate shape, as shown in FIG. 3.

As best shown in FIG. 4, a pair of compression spaces 12, 12 are defined at diametrically opposite locations between an inner peripheral surface of the cam ring 1 and an outer peripheral surface of the rotor 2 (one of the compression spaces is shown in FIG. 2). The rotor 2 has its outer peripheral surface formed therein with a plurality of axial vane slits 13 at circumferentially equal intervals, in each of which a vane 14 is radially slidably fitted. Each compression space 12 is divided by vanes 14 into compression chambers, the volume of each of which is varied with rotation of the rotor 2.

Two pairs of refrigerant outlet ports 16, 16 are formed through opposite lateral side walls of the cam ring 1 at diametrically opposite locations (only one pair of them is shown in FIG. 2). The opposite lateral side walls of the cam ring 1 are provided with two discharge valve covers 17, 17, each formed integrally with a valve stopper 17*a*, and fixed to the cam ring 1 by bolts 18. Discharge valves 19,19 are mounted between the respective lateral side walls of the cam ring 1 and the valve stoppers 17*a*, 17*a* in such a manner that they are supported by the valve covers 17, 17. When the refrigerant outlet ports 16, 16 are open, high-pressure refrigerant gas compressed within the compression chambers is delivered via the ports 16, 16, communication passages 2*a*, 3*a*, the discharge chamber 10 and the discharge port.

The cam ring 1 is formed with a pair of refrigerant inlet ports 12*a* at diametrically opposite locations of the rear-side end face thereof for supplying low-pressure refrigerant gas from the suction chamber 11 to the compression chambers (only one of the ports 12*a* is shown in (FIG. 2). As seen in FIG. 2, the end face 20*a* of the rear side member 20 in which the suction groove 11 opens is in direct contact with the end face 1*a* of the cam ring 1 which is formed with the refrigerant inlet ports.

The main component parts of the compression mechanism of the vane compressor, such as the cam ring, 1, the front side block 3, the front head 5, and the rear head 6, are formed of aluminum-based materials.

Next, the operation of the variable capacity vane compressor constructed as above will be explained below.

As torque is transmitted from an engine, not shown, to the drive shaft 7, the rotor 2 is driven for rotation. Refrigerant gas flowing out of an outlet port of an evaporator, not shown, is drawn into the suction chamber 11 of the compressor via the suction port 6*a* thereof. The refrigerant gas is drawn into the compression spaces 12 from the suction chamber 11 via the refrigerant inlet ports 12*a*. The compression spaces 12 are divided by the vanes into the compression chambers, each of which is varied in capacity with rotation of the rotor 2, as described above, whereby refrigerant gas trapped in each compression chamber is compressed, and the compressed refrigerant gas opens the discharge valve 19 to flow out via the refrigerant outlet ports 16 into the discharge chamber 10, followed by being discharged via the discharge port.

In the first embodiment, the groove or suction chamber 11 is formed in the cam ring-side end 20*a* of the rear head 6, and the refrigerant inlet ports 12*a* are formed in the rear-side end face 1*a* of the cam ring 1, the end 20*a* of the rear head 6 being in direct contact with the end face 1*a* of the cam ring 1 (as seen in FIG. 2), whereby the rear-side member 20 is formed by the rear head 6 alone which is secured to the rear-side end face of the cam ring 1. Therefore, a conventionally-used rear side block can be eliminated to reduce the number of component parts of the vane compressor, and the amount of aluminum-based materials used as a whole is reduced. Further, the number of portions requiring sealing is decreased, and the longitudinal length of the vane compressor can be shortened. As a result, the manufacturing costs can be reduced, while preventing leakage of refrigerant more effectively and reducing the size of the whole compressor.

Although in the first embodiment, the suction groove or chamber 11 is formed on the rear-side of the vane compressor, this is not limitative, but it may be provided on the front-side of the same. Further, the suction groove or chamber 11 may be formed along the compression spaces 12 to form an annular shape.

Figure 5:
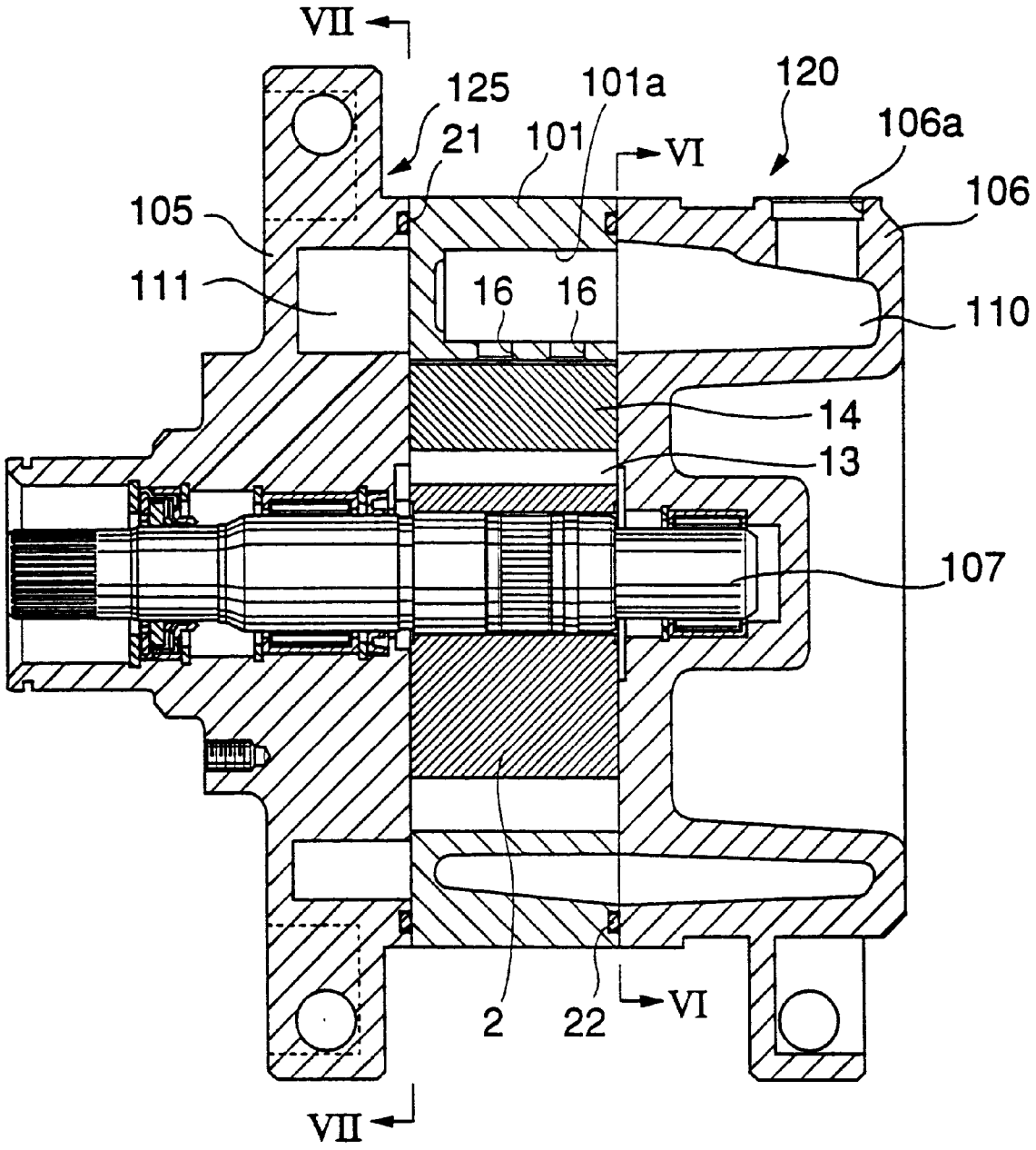
FIG. 5 is a longitudinal cross-sectional view showing the whole arrangement of a vane compressor according to a second embodiment of the invention.
Figure 6:
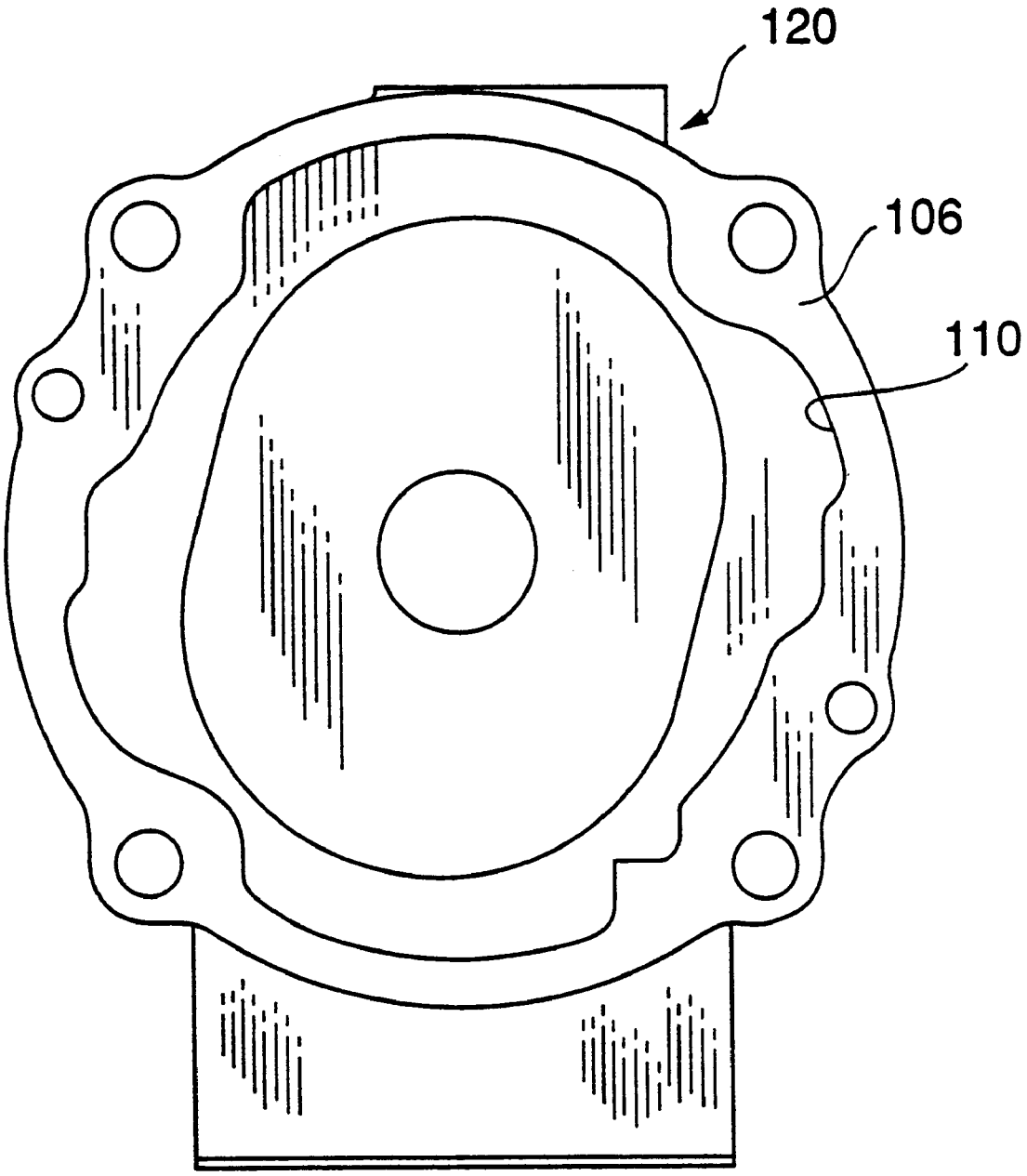
FIG. 6 is an end view of the FIG. 5 vane compressor taken on line VI—VI of FIG. 5.
Figure 7:
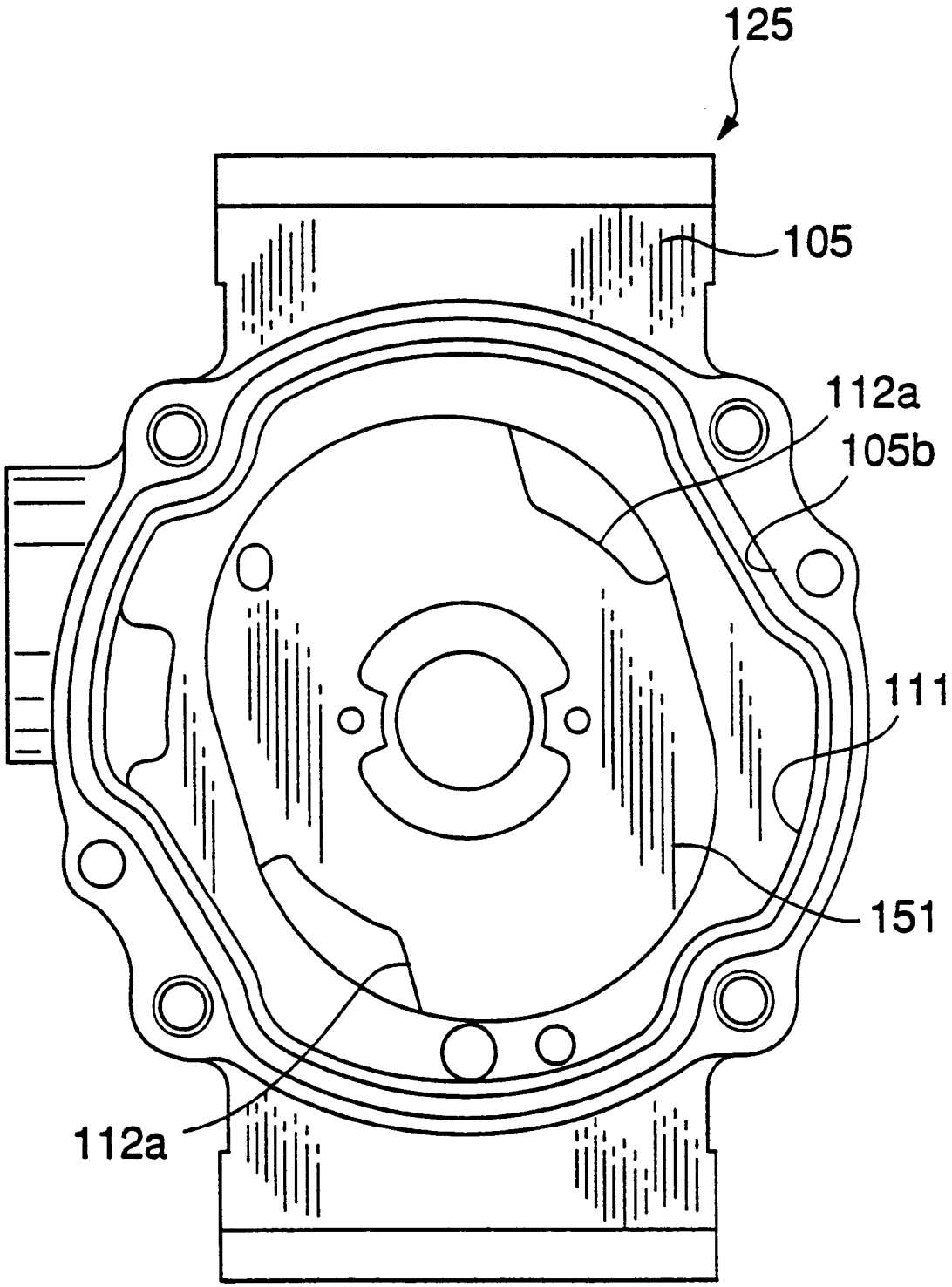
FIG. 7 is an end view of the FIG. 5 vane compressor taken on line VII—VII of the FIG. 5.

FIG. 5 is a longitudinal cross-sectional view of a vane compressor according to a second embodiment of the invention. FIG. 6 is an end view of the FIG. 5 vane compressor taken on line VI—VI of FIG. 5, and FIG. 7 is an end view of the FIG. 5 vane compressor taken on line VII—VII of the FIG. 5. Component parts and elements similar to those of the first embodiment are designated by identical reference numerals, and detailed description thereof will be omitted.

In the first embodiment, the front-side member 25 is formed by the front side block 3 secured to the front-side end face of the cam ring 1 and the front head 5 secured to the front-side end face of the front side block 3, while the rear-side member 20 is formed by the rear head 6 alone which is secured to the rear-side end face of the cam ring 1.

The second embodiment is distinguished from the first embodiment in that, as shown in FIG. 5, the vane compressor has a front-side member 125 formed by a front head 105 alone which is secured to a front-side end face of a cam ring 101, and a rear-side member 120 formed by a rear head 106 alone which is secured to a rear-side end face of the cam ring 101.

The rear head 106 is formed with a discharge chamber 110 opening toward the cam ring 101, which is in the form of an annulus extending along the circumference of a central recess formed in the rear head 106 for receiving a rear-side end of a drive shaft 107 (see FIG. 6). The discharge chamber 110 communicates with a discharge port 106*a* formed through a wall of the rear head 106 and with a discharge valve-receiving chamber 101*a* formed in a wall of the cam ring 101. The discharge valve-receiving chamber 101*a* receives discharge valves, not shown, for opening and closing the refrigerant outlet ports 16.

As shown in FIG. 7, the front head 105 has a sliding surface 151 facing the cam ring 101, on which slide a front-side end face of the rotor 2 and front-side end faces of the vanes 14. The front head 105 has a suction groove or chamber 111 formed therein which opens in a cam ring-side end face of the front head 105 and extends along the periphery of the sliding surface 151, and an O ring groove 105*b* formed on the cam ring-side end face thereof such that it extends around the suction chamber 111. The sliding surface 151 is formed with refrigerant inlet ports 112*a*, 112*a* in the form of a cutout portion at diametrically opposite locations thereof for supplying low-pressure refrigerant gas to the compression chambers.

As described above, since the suction chamber 111 is formed in the front head 105, which opens in the cam ring-side end face of the front head 105 and extends along the periphery of the sliding surface 151, and the refrigerant inlet ports 112*a*, 112*a* are formed in the sliding surface 151, the front-side member 125 can be formed by the front head 105 alone, whereby the cam ring-side end face of the front head 105 can be secured to the front-side end face of the cam ring 101 without a front side block therebetween. Further, as described above, since the discharge chamber 110 in the form of an annulus is formed in the cam ring-side end face of the rear head 106, the rear-side member 120 can be formed by the rear head 106 alone, whereby the cam ring-side end face of the rear head 106 can be secured to the rear-side end face of the cam ring 101 without a rear side block therebetween.

According to the second embodiment of the invention, as described above, the front-side member 125 conventionally formed by a front head and a front side block is formed by a single component (front head 105) as a unitized member of the front head and the front side block, and the rear-side member 120 conventionally formed by a rear head and a rear side block is formed by a single component (rear head 106) as a unitized member of the rear head and the rear side block. Therefore, the front and rear side blocks can be eliminated to reduce the number of component parts of the compressor and the whole amount of aluminum-based materials used. Further, the number of portions requiring sealing is decreased, and the longitudinal length of the vane compressor can be shortened. As a result, the manufacturing costs can be reduced, while preventing leakage of refrigerant more effectively and reducing the size of the whole compressor.

Figure 8:
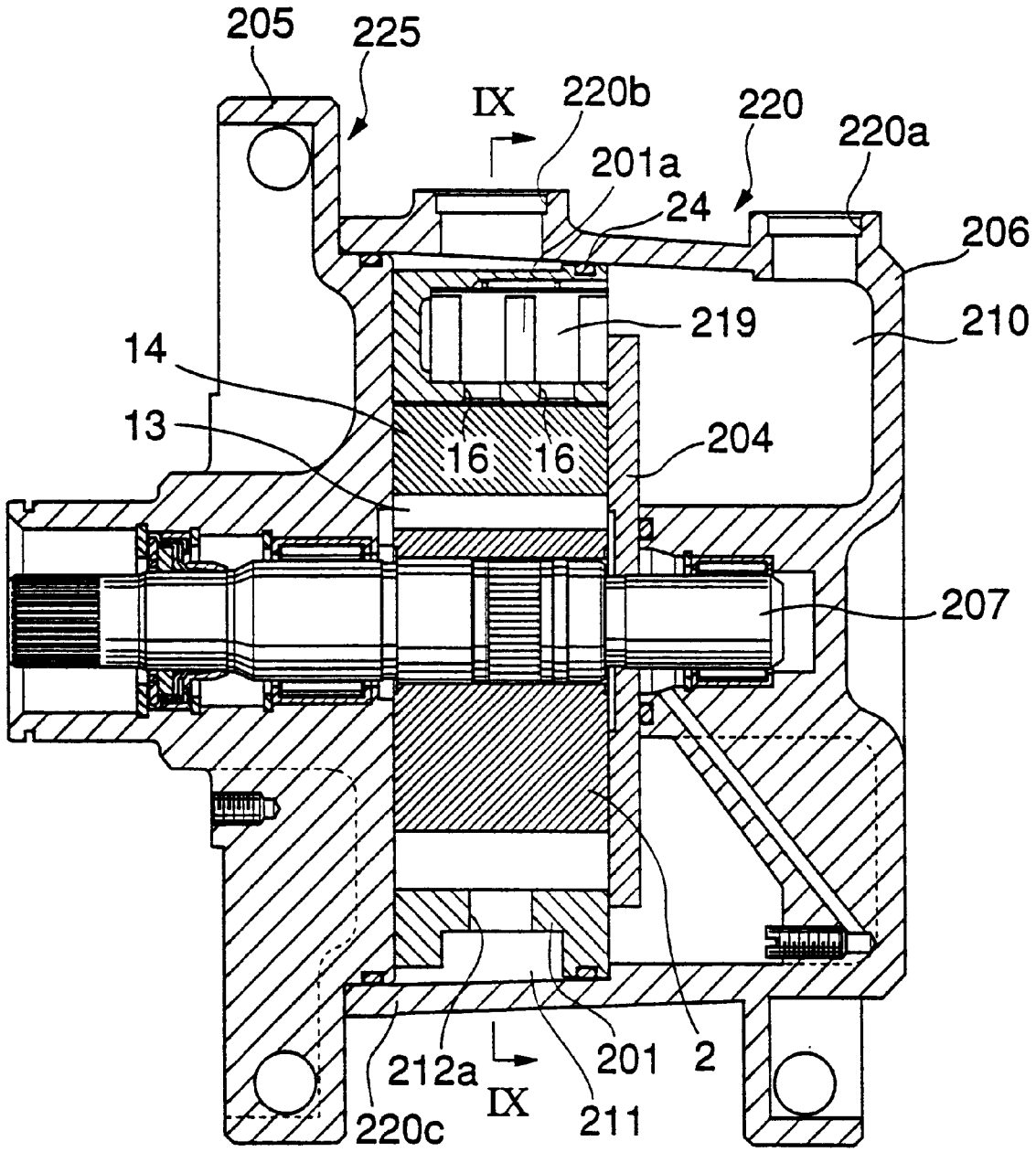
FIG. 8 is a longitudinal cross-sectional view showing the whole arrangement of a vane compressor according to a third embodiment of the invention.
Figure 9:
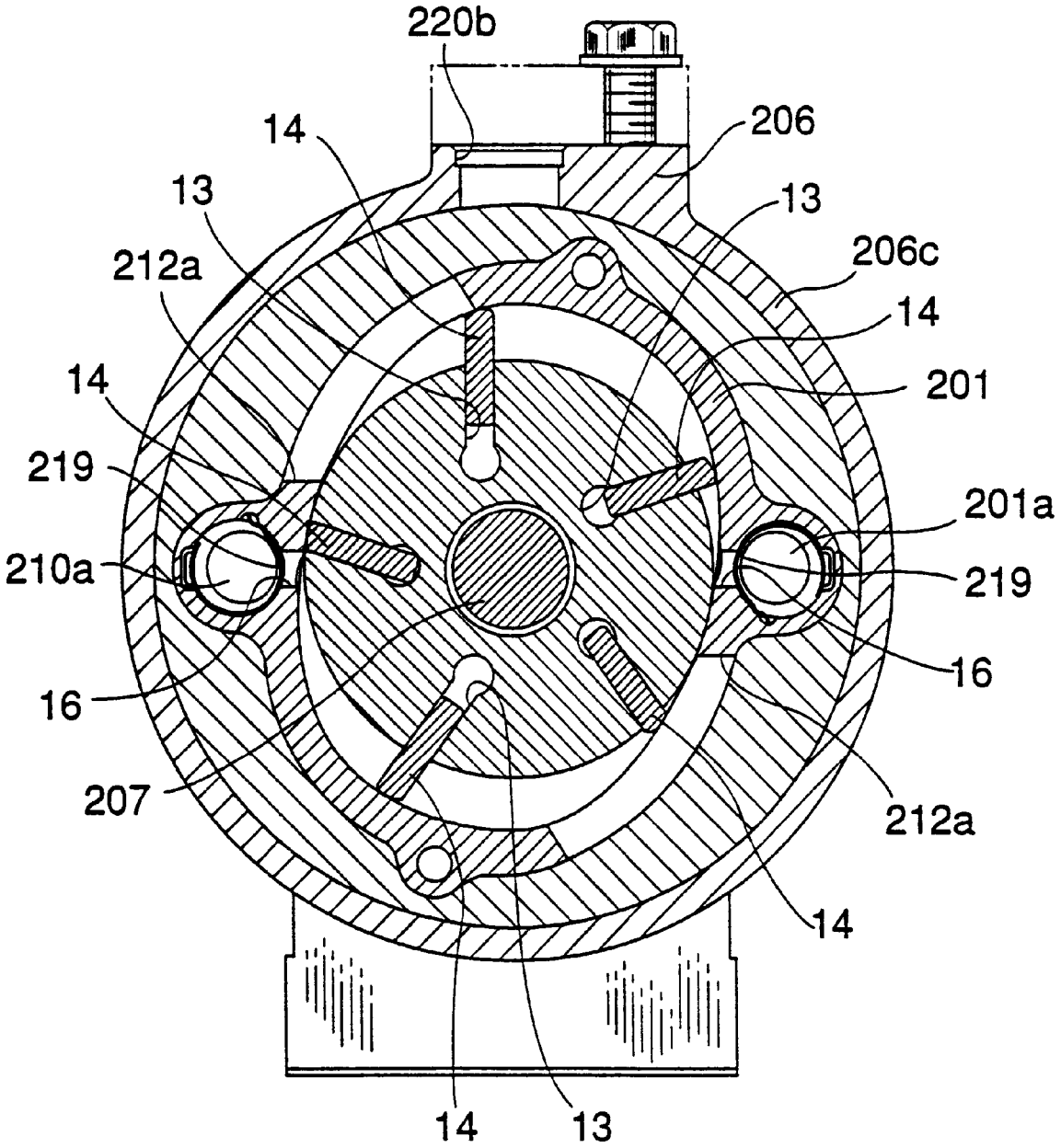
FIG. 9 is a cross-sectional view of the FIG. 8 vane compressor taken on line IX—IX of FIG. 8.

FIG. 8 is a longitudinal cross-sectional view of a vane compressor according to a third embodiment of the invention. FIG. 9 is a cross-sectional view of the FIG. 8 vane compressor taken on line IX—IX of FIG. 8. It should be noted that FIG. 8 shows a modified cross-section to show essential components in one figure. Component parts and elements similar to those of the preceding embodiments are designated by identical reference numerals, and detailed description thereof will be omitted.

In the third embodiment, a shell 220 encloses a rear-side end face and an outer peripheral surface of the cam ring 201, and a movable plate 204 is held by the shell 220 in a fashion opposed to the rear-side end face of the cam ring such that it is slightly movable along the axis of the drive shaft 207 for adjustment of the state of a sliding contact thereof with the rear-side end faces of the vanes. A front-side member 225 is formed by a front head 205 alone.

The shell 220 has a discharge chamber (high-pressure chamber) 210 formed therein, and the movable plate 204 separates the compression chambers formed between the vanes and the discharge chamber 210.

The discharge chamber 210 communicates with a discharge port 220*a* formed through the wall of the shell 220, and a discharge valve-receiving chamber 201*a* formed in the cam ring 201. The discharge valve-receiving chamber 201*a* receives discharge valves 219 for opening and closing refrigerant outlet ports 16 (in FIG. 8, only one pair of the discharge ports 16 and one of the discharge valves 219 are shown).

The shell 220 has a front-side end 220*c* (wall portion leftward of an O ring 24 of FIG. 8) which extends past the cam ring 201 to the front head 205 such that it encloses the outer peripheral surface of the cam ring 201, and is fixed to the front head 205.

A suction chamber (low-pressure chamber) 211 is formed between the outer peripheral surface of the cam ring 201 and the inner peripheral surface of the front-side end 220*c* extending over the cam ring 201, and refrigerant inlet ports 212*a*, 212*a* are formed through an outer peripheral wall of the cam ring 201 (in FIG. 8, one of the refrigerant inlet ports 212*a* is shown) for supplying low-pressure refrigerant gas from the suction chamber 211 to the compression chambers. The suction chamber 211 communicates with a suction port 220*b* formed through the front-side end 220*c* of the shell 220.

In the third embodiment, as described above, the front-side member 225 is formed by a single component part (front head 205), and the front-side end 220*c* of the shell 220 encloses the outer peripheral surface of the cam ring 201 and is fixed to the front head 205. Further, the suction chamber 201 is formed between the outer peripheral surface of the cam ring 201 and the inner peripheral surface of the front-side end 220*c* of the shell 220, and the refrigerant inlet ports 212*a*, 212*a* for supplying the refrigerant gas from the suction chamber 211 to the compression chambers is formed through the outer peripheral wall of the cam ring 201. Therefore, the side blocks can be eliminated to reduce the number of component parts of the compressor and the whole amount of aluminum-based materials used. Further, the number of portions requiring sealing is decreased, and the longitudinal length of the vane compressor can be shortened. As a result, the manufacturing costs can be reduced, while preventing leakage of refrigerant more effectively and reducing the size of the whole compressor.

Further, since the discharge valve-receiving chamber 201*a* formed in the cam ring 201 is surrounded by the suction chamber 211, leak of noise from the discharge valve-receiving chamber 201*a* to the outside of the compressor can be reduced.

Further, since both the suction port 220*b* and the discharge port 220*a* are formed in the same component part, i.e. the shell 220, the accuracy of machining is not required to be so high as demanded of a conventional vane compressor in which these component parts are machined individually and separately.

Figure 10:
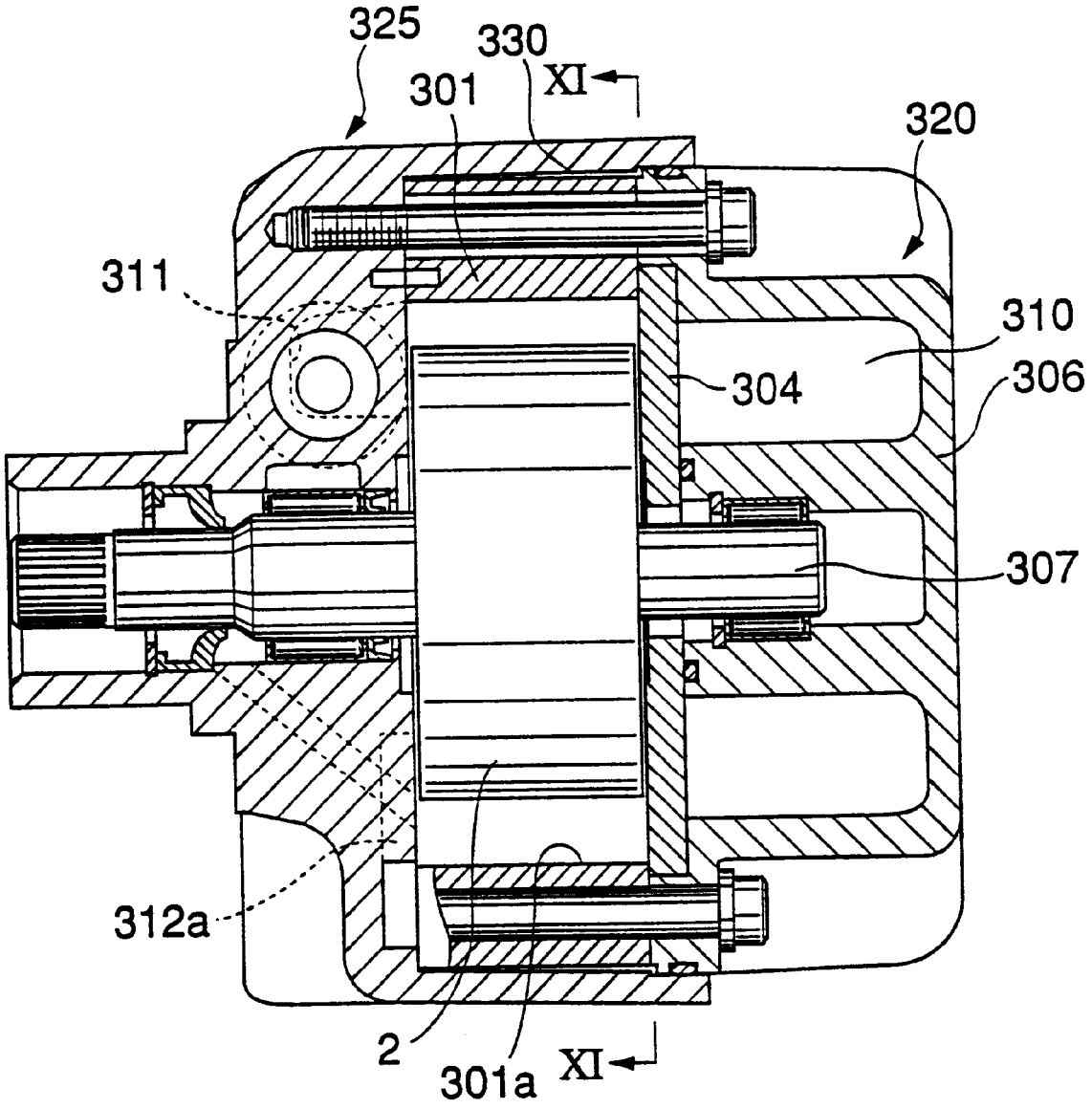
FIG. 10 is longitudinal cross-sectional view showing the whole arrangement of a vane compressor according to a fourth embodiment of the invention.
Figure 11:
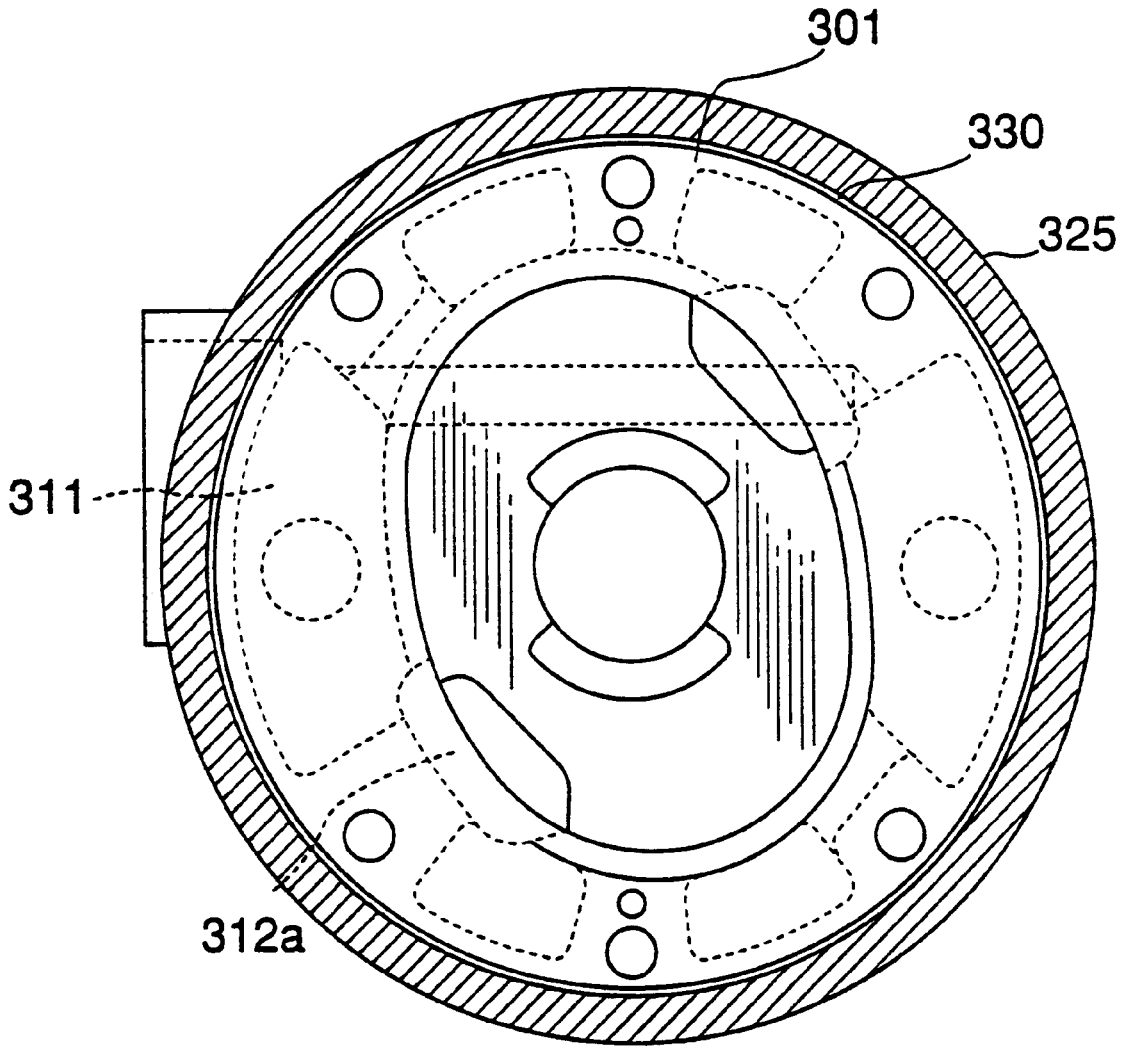
FIG. 11 is a cross-sectional view of the FIG. 10 vane compressor taken on line XI—XI of FIG. 10.

FIG. 10 is a longitudinal cross-sectional view of a vane compressor according to a fourth embodiment of the invention. FIG. 11 is a cross-sectional view of the FIG. 10 vane compressor taken on line XI—XI of FIG. 10. Component parts and elements similar to those of the preceding embodiments are designated by identical reference numerals, and detailed description thereof will be omitted.

In the fourth embodiment, contrary to the third embodiment, a front-side part of a vane compressor has a shell structure.

A shell 325 encloses a front-side end face and an outer peripheral surface of a cam ring 301, and is fixed to a rear head 306 of a rear-side member 320.

The shell 325 has a suction chamber (low-pressure chamber) 311 substantially in the form of an annulus formed therein which opens toward the cam ring 310 and extends around a hole receiving a drive shaft 307, and refrigerant inlet ports 312*a* formed in a cam ring-side end face thereof for supplying low-pressure refrigerant gas from the suction chamber 311 to the compression chambers formed between the vanes 14 during the suction stroke.

The rear-side member 320 is formed by the rear head 306 arranged on a rear side of the cam ring 301, and a movable plate 304 held by the rear head 306 in a state opposed to the rear-side end face of the cam ring 301 such that it is slightly movable along the axis of the drive shaft 307 for adjustment of the state of a sliding contact thereof with the rear-side end faces of the vanes 14.

The rear head 306 has a discharge chamber (high-pressure chamber) 310 formed therein which opens toward the cam ring for being supplied with high-pressure refrigerant gas discharged from the compression chambers. The movable plate 304 separates the compression chambers formed between the vanes 14 and the discharge chamber 310 from each other.

In the fourth embodiment, as described above, the front-side member 325 is formed by a single component part (shell 325 alone), and the rear-side member 320 is formed by the rear head 306 and the movable plate 304. Further, the shell 325 encloses the outer peripheral surface of the cam ring 301 and is fixed to the rear head 306, and has the suction chamber 311 and the refrigerant inlet ports 312*a* formed therein both of which open toward the cam ring. Therefore, side blocks can be eliminated to reduce the number of component parts of the compressor and the whole amount of aluminum-based materials used. Further, the number of portions requiring sealing is largely decreased, and the longitudinal length of the vane compressor can be shortened. As a result, the manufacturing costs can be reduced, while preventing leakage of refrigerant more effectively and reducing the size of the whole compressor.

Further, a low-pressure space 330 is formed between the outer peripheral surface of the cam ring 301 and an inner peripheral surface of the shell 325. The low-pressure space 330 encloses the outer peripheral surface of the cam ring 301, so that no force is applied to the cam ring 301 in a radially inward direction, whereby the inner peripheral surface of the cam ring 301 can be prevented from being brought into contact with the outer peripheral surface of the rotor 2, and at the same time, in a so-called liquid compression state of the compressor, the pressure within the compression space 301*a* within the cam ring 301 higher than the pressure within the low-pressure space 330 expands the cam ring 301 to lower the pressure within the compression space 301*a*, to thereby prevent breakage of the compressor due to the liquid compression.

Figure 12:
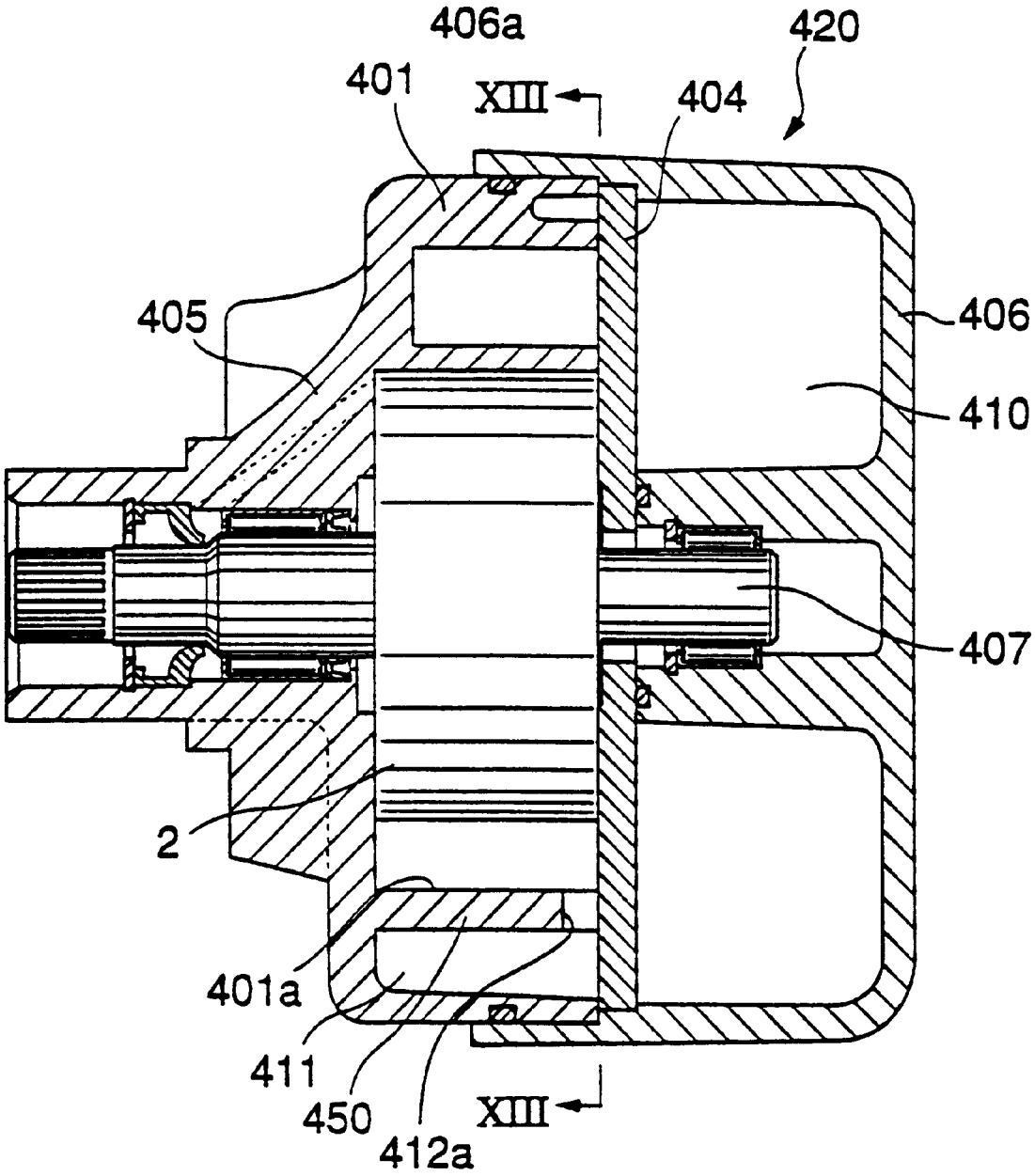
FIG. 12 is a longitudinal cross-sectional view showing the whole arrangement of a vane compressor according to a fifth embodiment of the invention.
Figure 13:
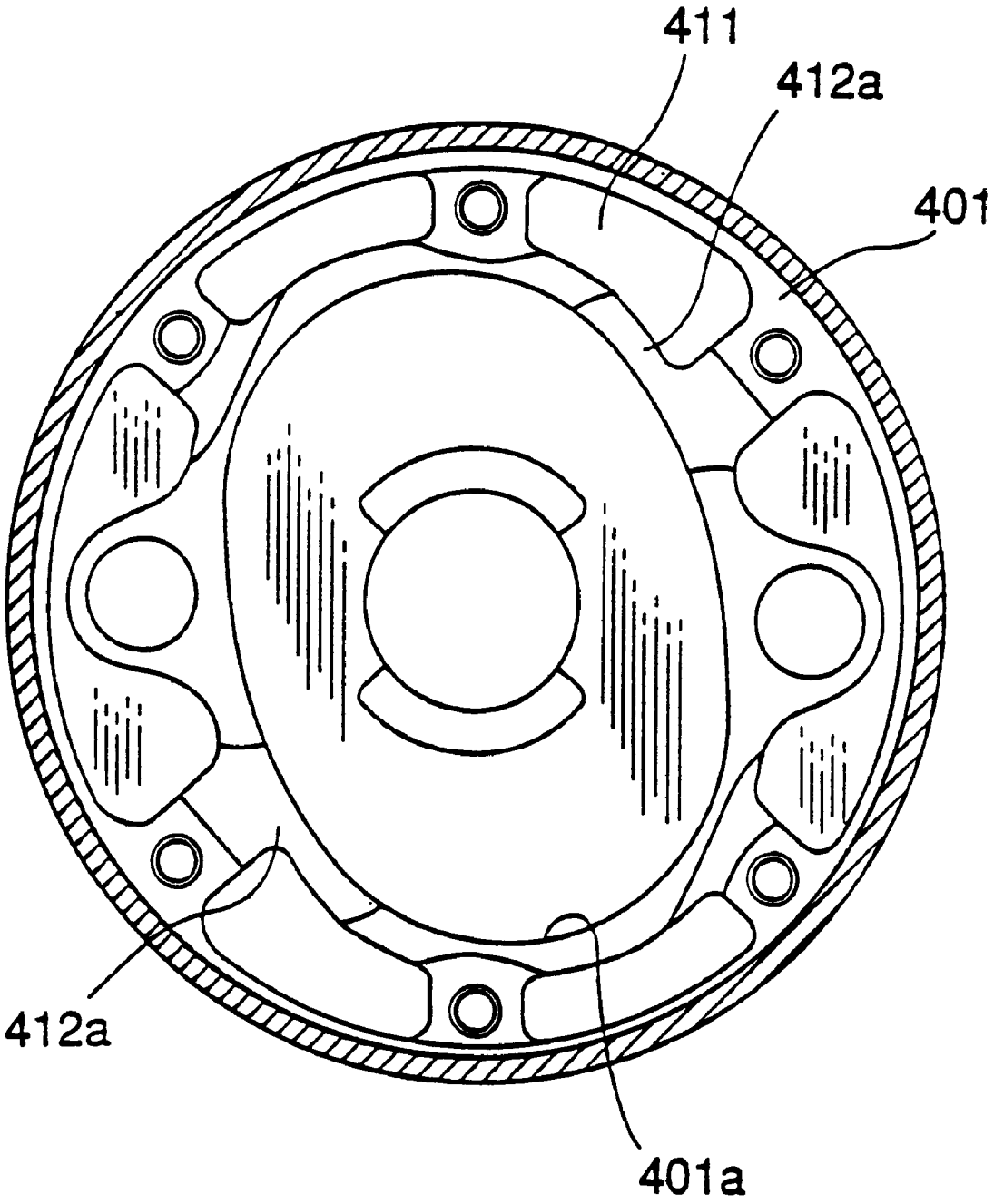
FIG. 13 is an end view of the FIG. 12 vane compressor taken on line XIII—XIII of FIG. 12.

FIG. 12 is a longitudinal cross-sectional view of a vane compressor according to a fifth embodiment of the invention. FIG. 13 is a cross-sectional view of the FIG. 12 vane compressor taken on line XIII–XIII of FIG. 12. Component parts and elements similar to those of the preceding embodiments are designated by identical reference numerals, and detailed description thereof will be omitted.

In the fifth embodiment, a cam ring 401 and a front head 405 arranged on a front side of the cam ring 401 is formed as a unitary member. The cam ring 401 has a suction chamber (low-pressure chamber) 411 formed in a wall defining the compression spaces, which opens toward the rear head 406 and is substantially in the form of an annulus which extends around a drive shaft 407, and refrigerant inlet ports 412*a* formed through an inner wall 450 of the suction chamber 411 separating the suction chamber from the compression spaces 401*a* within the cam ring 401 for supplying refrigerant gas from the suction chamber 411 to the compression chambers formed between the vanes during the suction stroke.

The vane compressor of this embodiment has a rear-side member 420 formed by a rear head 406 arranged on a rear side of the cam ring 401, and a movable plate 404 held by the rear head 406 in a state opposed to the rear-side end face of the cam ring 401 such that it is slightly movable along the axis of the drive shaft 407 for adjustment of the state of a sliding contact thereof with the rear-side end faces of the vanes. The rear head 406 has a discharge chamber (high-pressure chamber) 410 formed therein which opens toward the cam ring 401, for being supplied with high-pressure refrigerant gas discharged from the compression chambers. The movable plate 404 separates the compression chambers formed between the vanes from the discharge chamber 410, and the discharge chamber 410 from the suction chamber 411. The rear head 406 has a front-side end 406*a* fixed to the outer peripheral surface of the cam ring 401 such that the front-side end 406*a* encloses part of the cam ring 401.

In the fifth embodiment, as described above, the front-side member is formed by a single component part (the cam ring 401 and the front head 405 formed as a unitary member), and the rear-side member 420 is formed by the rear head 406 and the movable plate 404. Further, the front-side end 406*a* of the rear head 406 is formed such that it encloses the cam ring 401 and is fixed to the outer peripheral surface of the same, while the suction chamber 411 is formed in the cam ring 401 such that it opens toward the rear-side and the refrigerant inlet ports 412*a* are formed through the inner wall 450 separating the suction chamber 411 from the compression spaces 401*a*. Therefore, side blocks can be eliminated to reduce the number of component parts of the compressor and the whole amount of aluminum-based materials used. Further, the number of portions requiring sealing is largely decreased, and the longitudinal length of the vane compressor can be shortened. As a result, the manufacturing costs can be reduced, while preventing leakage of refrigerant more effectively and reducing the size of the whole compressor.

Further, compression spaces 401*a* within the cam ring 401 are surrounded by the suction chamber 411 formed in the wall of the cam ring 401, so that no force is applied in a radially inward direction to the inner wall 450 separating the suction chamber 411 and the compression spaces 401*a* from each other, whereby the inner peripheral surface of the cam ring 401 can be prevented from being brought into contact with the outer peripheral surface of the rotor 2, and at the same time, in a so-called liquid compression state of the compressor, the pressure within the compression spaces 401*a* within the cam ring 401 higher than the pressure within the low-pressure space 411 expands the wall 450 of the cam ring 401 to lower the pressure within the compression space 401*a*, to thereby prevent breakage of the compressor due to the liquid compression.

Further, in the fifth embodiment, the front side block is eliminated as described above, and the front head 405 and the cam ring 401 is formed as a unitary member. This makes the process of aligning unnecessary.

Figure 14:
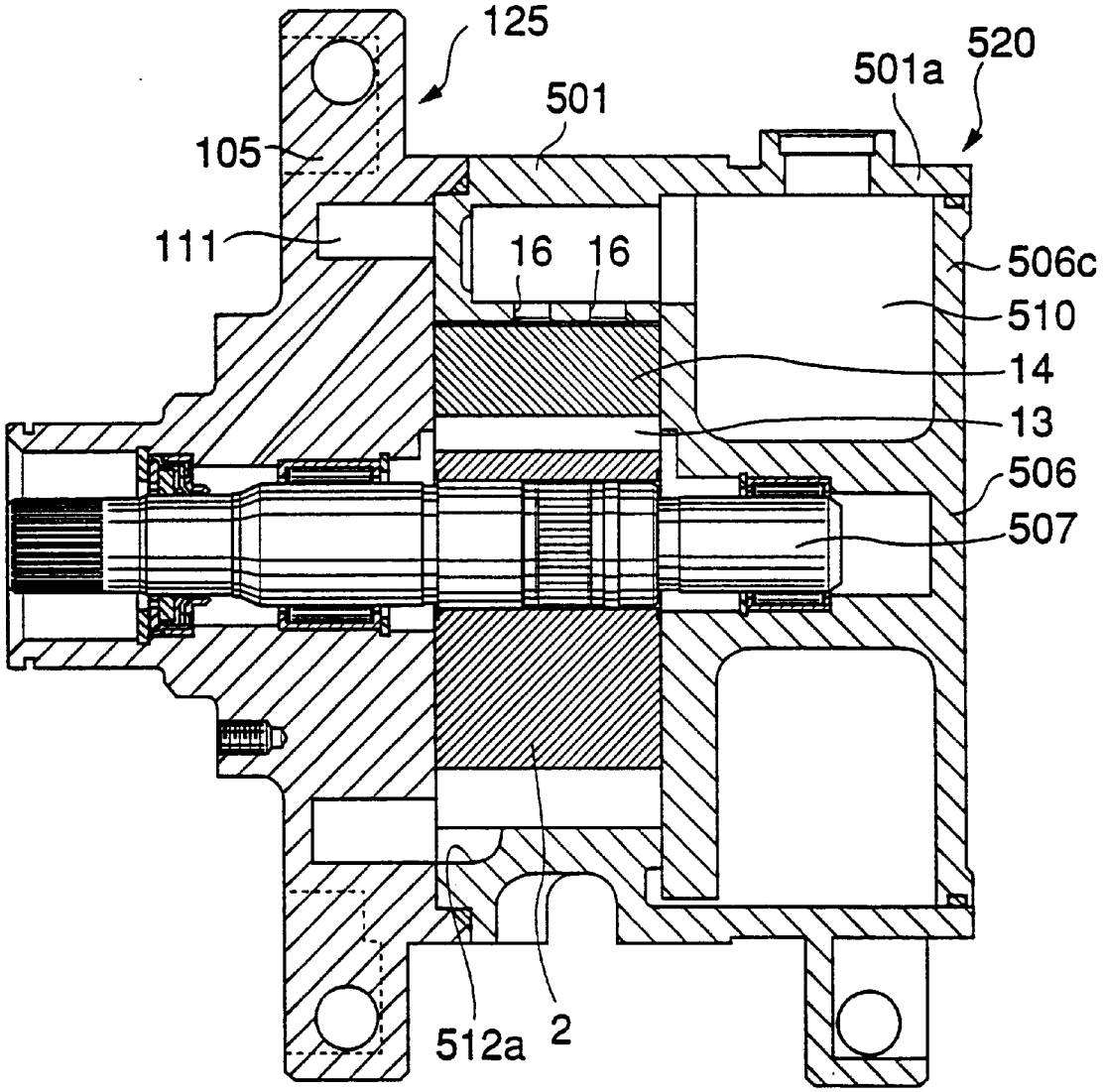
FIG. 14 is a longitudinal cross-sectional view showing the whole arrangement of a vane compressor according to a sixth embodiment of the invention.

FIG. 14 is a longitudinal cross-sectional view of a vane compressor according to a sixth embodiment of the invention. Component parts and elements similar to those of the preceding embodiments are designated by identical reference numerals, and detailed description thereof will be omitted.

In the sixth embodiment, similarly to the FIG. 5 vane compressor of the second embodiment, a front-side member 125 is formed by a front head 105 alone, and the front head 105 has a suction chamber (low-pressure chamber) 111 formed therein which opens toward a cam ring 501, and has an annular shape extending around a hole receiving a drive shaft 507.

This embodiment is similar to the FIG. 10 vane compressor of the fourth embodiment in that the cam ring 501 has a front-side end formed with refrigerant inlet ports 512*a* for supplying low-pressure refrigerant gas from the suction chamber 111 to the compression chambers during the suction stroke.

On the rear side of the rotor 2 is arranged a rear head 506 which is substantially H-shaped in cross-section.

The cam ring 501 has a rear-side end 501*a* of an outer peripheral wall, which encloses the rear head 506 and is fixed to a rear-side end 506*a* of the rear head 506.

The rear-side end 501*a* of the outer peripheral wall of the cam ring 501 and the rear head 506 define therein a discharge chamber (high-pressure chamber) 510 for being supplied with the high-pressure refrigerant gas discharged from the compression chambers.

In the sixth embodiment, as described above, the front-side member is formed by a single component (front head 105 alone), and the front head 105 is formed with the suction chamber 111 which opens toward the cam ring 501, with the refrigerant inlet ports 512*a* being formed in a front-side end face of the cam ring 501. The rear head 506 has a substantially H-shaped cross-section and is arranged on the rear side of the rotor 2. Further, the rear-side end 501*a* of the outer peripheral wall of the cam ring 501 is formed such that it encloses the rear head 506 and is fixed to the rear-side end 501*a* of the rear head 506, whereby rear-side member 520 is formed by the rear head 506 and the rear-side end wall 501*a* of the cam ring 501. Thus, front and rear side blocks can be eliminated to reduce the number of component parts of the compressor and the whole amount of aluminum-based materials used. Further, the number of portions requiring sealing is decreased, and the longitudinal length of the vane compressor can be shortened. As a result, the manufacturing costs can be reduced, while preventing leakage of refrigerant more effectively and reducing the size of the whole compressor.

Further, in the sixth embodiment of the invention, the discharge chamber 510 is formed by the rear-side end (extension) 501*a* of the outer peripheral wall of the cam ring 501 and the rear head 506 having a H-shaped cross-section. Therefore, a large space can be secured for the discharge chamber 510, which therefore can sufficiently play the role of an oil sump for supplying oil to the sealing portions.

Figure 15:
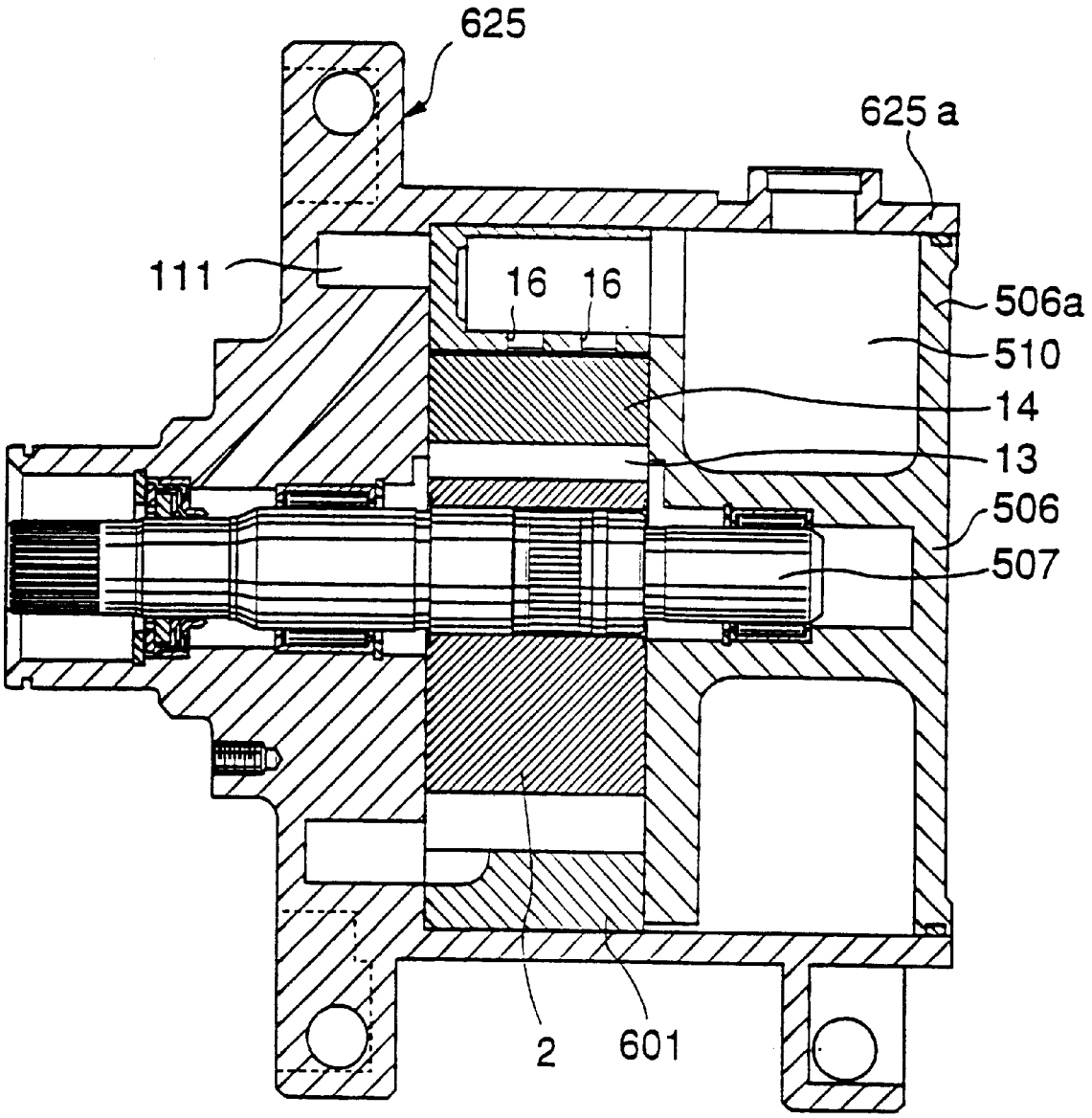
FIG. 15 is a longitudinal cross-sectional view showing the whole arrangement of a vane compressor according to a seventh embodiment of the invention.

FIG. 15 is a longitudinal cross-sectional view of a vane compressor according to a seventh embodiment of the invention. Component parts and elements similar to those of the preceding embodiments are designated by identical reference numerals, and detailed description thereof will be omitted.

The seventh embodiment is slightly varied from the sixth embodiment.

In the seventh embodiment, on a rear side of a cam ring 601 is arranged a rear head 506 which is substantially H-shaped in cross-section, and a shell 625 encloses a front-side end and an outer peripheral surface of the cam ring 601, and an outer peripheral surface of the rear head 506. A rear-side end 625*a* of the shell 625 is fixed to a rear-side end 506*a* of the rear head 506.

The seventh embodiment can provide the same advantageous effects as obtained by the sixth embodiment.

Figure 16:
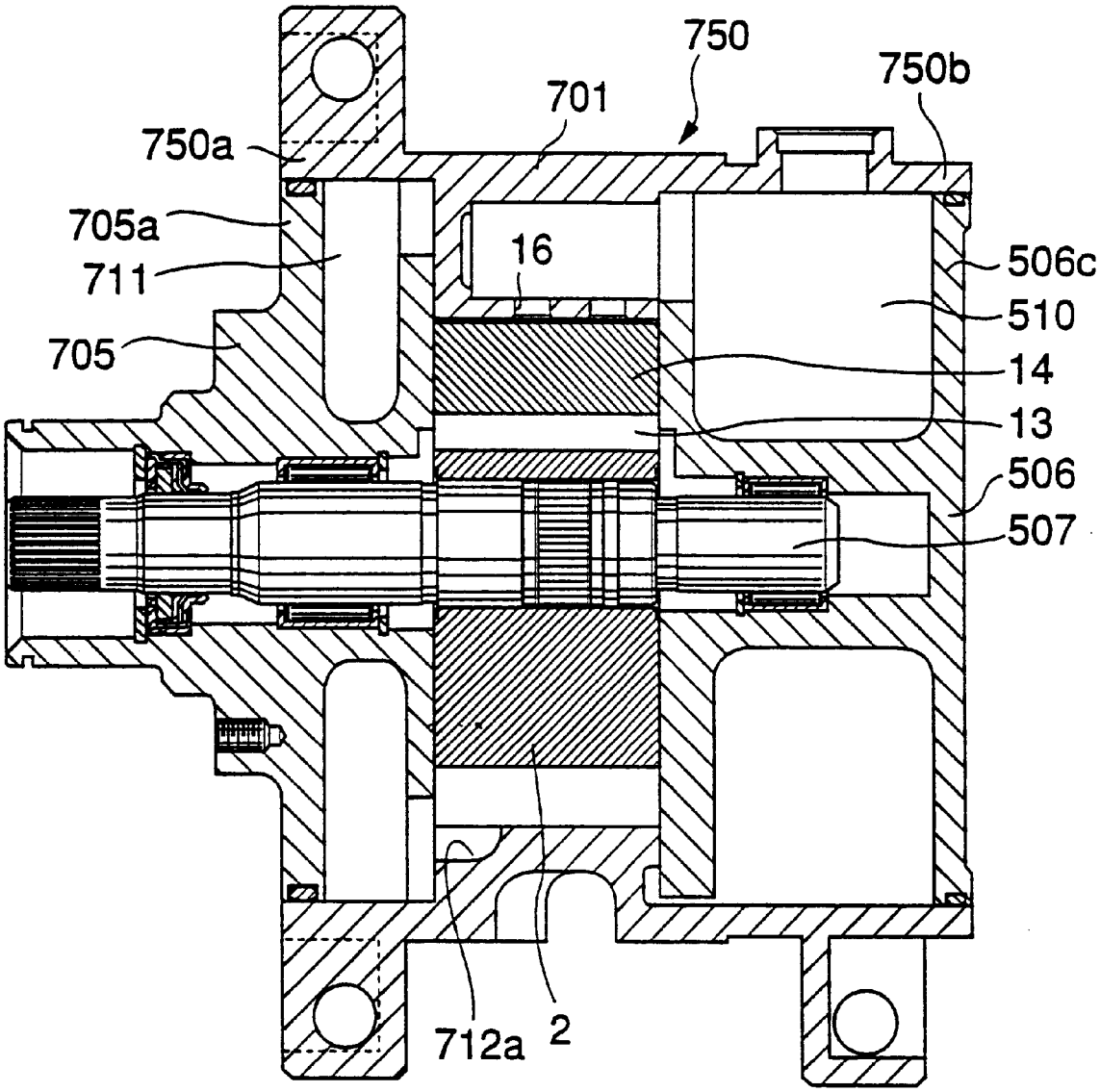
FIG. 16 is a longitudinal cross-sectional view showing the whole arrangement of a vane compressor according to an eighth embodiment of the invention.

FIG. 16 is a longitudinal cross-sectional view of a vane compressor according to an eighth embodiment of the invention. Component parts and elements similar to those of the preceding embodiments are designated by identical reference numerals, and detailed description thereof will be omitted.

The eighth embodiment is also slightly varied from the sixth embodiment.

In the eighth embodiment, on a front side of a cam ring 701 is arranged a front head 705 which is substantially H-shaped in cross-section, and a shell 750 and the cam ring 701 are formed as a unitary member. The shell has a front-side end (extension) 750*a* enclosing the front head 705 and fixed to a front-side end 705*a* of the front head 705. The shell 750 has a rear-side end (extension) 750*b* fixed to a rear-side end 506*c* of the rear head 506. The front-side end 750*a* of the shell 750 and the front head 705 define a suction chamber (low-pressure chamber) 711 therein, while the rear-side end 750*b* of the shell 750 and the rear head 506 defines a discharge chamber (high-pressure chamber) 510 therein. Further, refrigerant inlet ports 712*a* are formed in the front-side-end face of the cam ring 701.

The eighth embodiment can provide the same advantageous effects as obtained by the sixth embodiment.

What is claimed is:

1. A vane compressor comprising:

a cam ring, a front-side member arranged on one end face of said cam ring, a rear-side member arranged on another end face of said cam ring, a drive shaft rotatably supported by said front-side member and said rear-side member and extending through said cam ring, and a rotor rigidly fitted on said drive shaft and rotatably received within said cam ring, said rotor having a plurality of vane slits formed therein, and vanes respectively received within said vane slits, wherein at least one of said front-side member and rear-side member is formed with a single suction groove opening in an end face thereof facing toward said cam ring, said single suction groove having one of a substantially arcuate and annular shape and being formed radially outward of said drive shaft in a manner spaced from said drive shaft;

wherein one of said one and another end faces of said cam ring is formed with a plurality of refrigerant inlet ports for supplying a low-pressure refrigerant into compression chambers formed between said vanes of said rotor during a suction stroke; and wherein said end face of said at least one of said front-side member and said rear-side member in which said suction groove opens is in direct contact with said one of said one and another end faces formed with said refrigerant inlet ports, said suction groove being axially opposed to said refrigerant inlet ports.

2. A vane compressor according to claim 1, wherein said single suction groove is formed in a first one of said front-side member and said rear-side member, and a high-pressure chamber is formed in a second one of said front-side member and said rear-side member in a manner opening toward said cam ring for being supplied with a high-pressure refrigerant discharged from said compression chambers.

* * * * *